United States Patent [19]

Brennan

[11] 4,312,506

[45] Jan. 26, 1982

[54] BICEP EXERCISING CURLING BAR

[76] Inventor: William F. Brennan, 6 Mt. Paul Rd., Tyngsboro, Mass. 01879

[21] Appl. No.: 91,352

[22] Filed: Nov. 5, 1979

[51] Int. Cl.[3] ..... A63B 11/00

[52] U.S. Cl. ..... 272/123; 272/122

[58] Field of Search ..... 272/123, 122, 117, 116, 272/143, DIG. 4, 93, 67, 124

[56] References Cited

U.S. PATENT DOCUMENTS

| | | | |
|---|---|---|---|
| 734,062 | 7/1903 | Harris | 272/122 |
| 2,617,650 | 11/1952 | Landis | 272/122 |
| 4,231,569 | 11/1980 | Rae | 272/122 |

*Primary Examiner*—Richard C. Pinkham

*Assistant Examiner*—William R. Browne

*Attorney, Agent, or Firm*—Pearson & Pearson

[57] ABSTRACT

An exercising device in the form of a barbell or dumbell is designed for the development and strengthening of the bicep brachii. To avoid pronation of the wrists and permit curling exercises in the palms up, supine, hand position, without undue and prolonged wrist strain, the center of gravity of the device is moved rearwardly away from the hand grip during curling. This is achieved by use of a cushioned, weight-distributing, plate which has a hand grip rod laterally offset from, but parallel to, a pair of longitudinally spaced, weight-supporting rods, each projecting from an opposite end of the plate.

10 Claims, 8 Drawing Figures

Fig. 1.
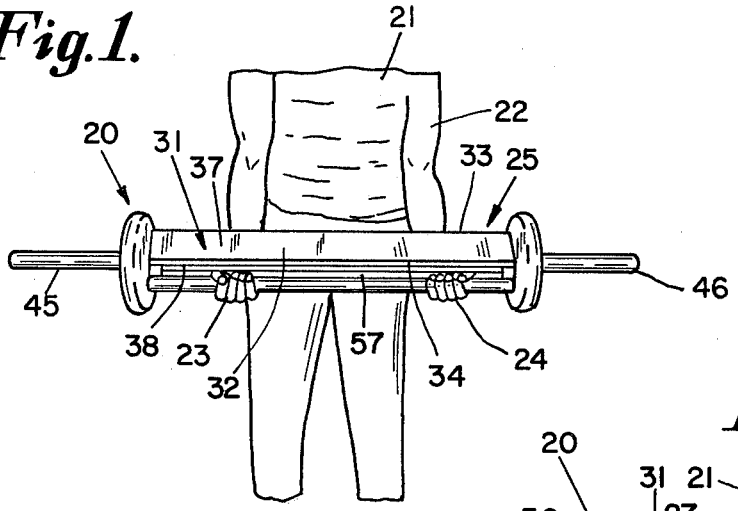
Fig. 2.
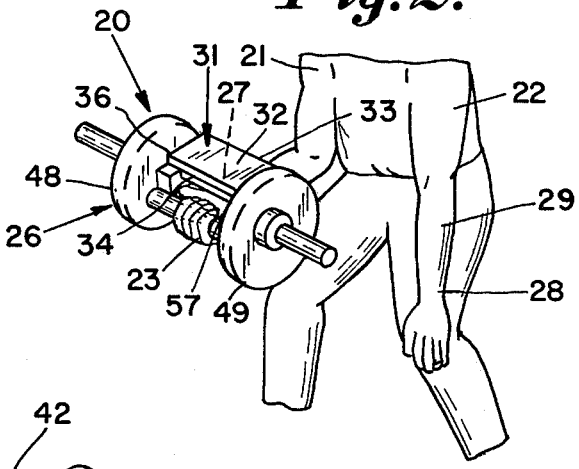
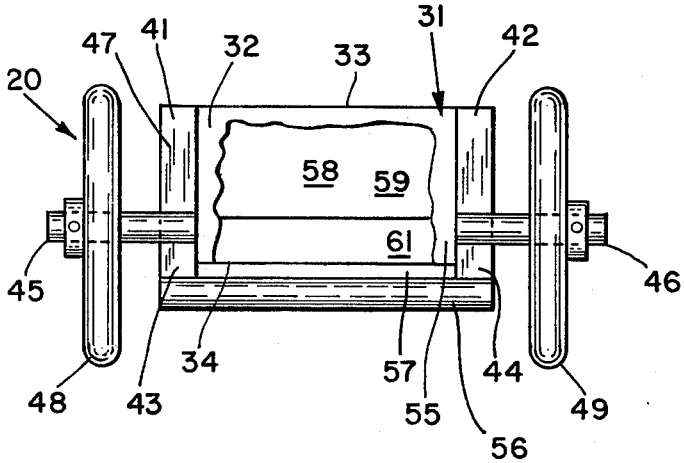
Fig. 3.
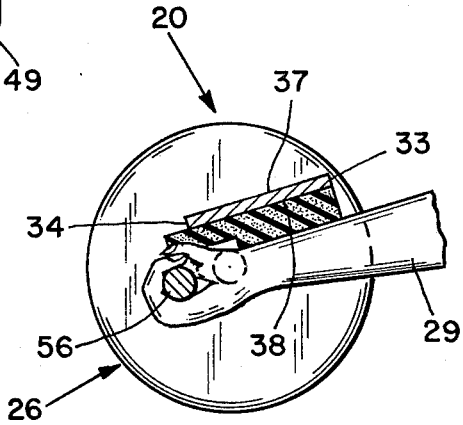
Fig. 4.

Fig. 5.
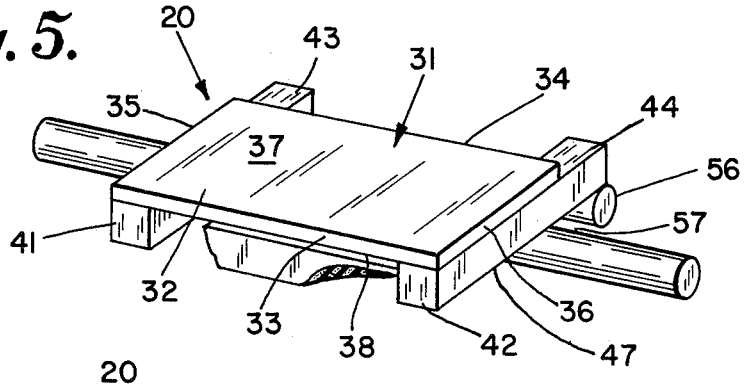
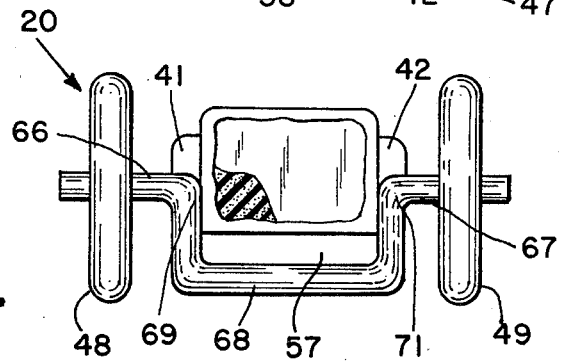
Fig. 6.
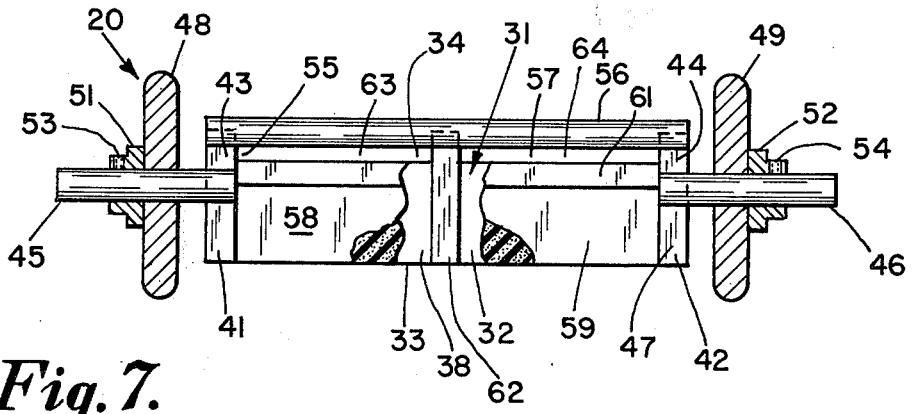
Fig. 7.
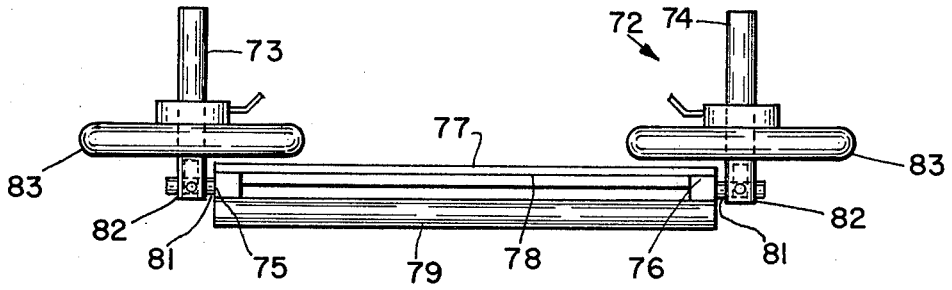
Fig. 8.

BICEP EXERCISING CURLING BAR

BACKGROUND OF THE INVENTION

The exercise used for bicep development and strengthening is the curling exercise, using a barbell or dumbells. The palms up supine hand position during the curling exercise is the key factor in the development of the bicep brachii, also known as the upper arm or just the biceps.

Prior to this invention the standard straight barbell and dumbells were best for the curling exercise, because, the bar for gripping is straight. If the hands are not held in a supine position during the curling exercise the biceps are not fully engaged in the exercise.

The problem that has plagued bodybuilders and weightlifters while doing the curling exercise with the straight barbell or dumbell is, the severe strain on the hands, wrist, and forearm muscles. The cause of this straining is, while curling, the center of gravity is centered on the supined palms of the hands. Therefore the hand, wrist, and forearm muscles are straining to hold the barbell parallel with the forearm. To do the exercise properly one has had to endure this wrist strain. The wrist straining problem with the standard straight barbell and dumbell has given rise to some novel devices to relieve the strain. These devices have basic flaws in their design, that have proved them impracticable for bicep development and strengthening. The most common flaw with these devices is that they try to relieve wrist strain by taking the hands out of supine position, which, in turn, diminishes the effective contraction of the bicep brachii. This defeats the purpose of the curling exercise.

DESCRIPTION OF THE PRIOR ACT

In U.S. Pat. No. 2,508,567 to Dymeck of May 23, 1950 a weight carrying bar is provided with integral, short, hand-grip portions which extend at an obtuse angle to the central and end portions. The palms of the hands of the user must face away from the supine position towards a more prone hand position, thereby not exercising the bicep in the preferred manner.

In U.S. Pat. No. 2,722,419 to Tarapczynsks of Nov. 1, 1955 discloses a weight carrying bar in which the short, integral, hand grip portions are at right angles to the end portions so that the hands face each other and do little for bicep development.

In U.S. Pat. No. 3,384,370 to Bailey of May 21, 1968, the hand grips are rotatable in rings so that they are either in continuous alignment to form a conventional straight bar or they must be physically retained forcibly in an angular or normal position.

A safety frame for weight lifting is disclosed in U.S. Pat. No. 4,018,442 of Apr. 19, 1977 to Galler, the user's body being within the hollow frame the hand grips being at right angles to the support rods, as in the Tarapczynsks patent above, and, the device is usuable for leg exercises and not for curling exercises.

SUMMARY OF THE INVENTION

The exercising device of this invention is of the dumbell or barbell type but instead of a straight weight-carrying rod, the central, hand grip portion of the rod is laterally offset from, but parallel to, the weight-carrying rods at each opposite end. A weight distributing plate is provided having a pair of end blocks each at an opposite end and the hand grip rod and the weight carrying rods are affixed to the blocks. The plate is padded so that when the device is held palms up, supine hand position and curled, the pad rests on the heel of the hand, wrist and lower forearm.

The bicep exercising curling bar of the invention is held in the palms up, supine position fully engaging the biceps. The center of gravity is moved back from the hand held bar to the padded plate behind the bar. The plate is padded with two levels of padding, to conform to the natural contour of the hand, wrist, and lower forearm. The center of gravity is moved back to the plate by interrupting the straight bar on both sides, and moving the weight support bars back to the center of the padded plate. The padded plate spans the hand, wrist, and lower forearm forming a brace. This brace supports the weight behind the hand held bar, allowing for complete exercising of the bicep brachii. The bicep is fully engaged with the supine hand in position and no hand, wrist, or forearm strain.

BRIEF DESCRIPTION OF THE DRAWING

FIG. 1 is a front view in perspective of a bicep exercising curling bar of the invention in use in the standing barbell curl position;

FIG. 2 is a view similar to FIG. showing a bicep exercising dumbell bar in use in a concentration curl FIG. 3 is a bottom plan view of the device shown in FIG. 2

FIG. 4 is an end elevation, in half section of the device shown in FIG. 3

FIG. 5 is a top perspective view of the device shown in FIGS. 2–4

FIG. 6 is a bottom plan view, similar to FIG. 3, of another embodiment

FIG. 7 is a bottom plan view of the barbell of the invention shown in FIG. 1 on an enlarged scale and FIG. 8 is a front view of another embodiment of the invention.

DESCRIPTION OF THE PREFERRED EMBODIMENT

As shown in the drawing the exercising device 20 is of the barbell or dumbell type and is especially useful as a bicep exercising curling bar. In FIG. 1 a user 21 having biceps brachii 22 is shown with his hands 23 and 24 in supine position but clenched to grip the barbell 25. In FIG. 2 the user 21 is shown with his right hand 23 in supine position but clenched to grip the dumbell 26. The position of FIG. 1 is designated the "barbell curl supine position" and the position of FIG. 2 is designated the "concentration curl dumbell" the hands being palms-up and there being no pronation of the hands 23 or 24. The wrists are designated 27 and 28 and the lower forearm is designated 29.

Each curling bar 25 or 26 of the invention includes plate means 31, preferably comprising a generally rectangular plate like member 32, of thin rigid metal material having a pair of opposite longer sides 33 and 34, a pair of opposite shorter ends 35 and 36 and a pair of opposite faces 37 and 38, plate means 31 also includes a pair of blocks 41 and 42, of square cross section, each welded, or otherwise affixed, along the underface 38 of plate member 32 to form a unitary, downwardly depending flange extending along one of the shorter ends 35 or 36 of the plate. Each block 41 or 42 has a portion 43 or 44 which projects beyond the adjacent side such as 34 of the platelike member 32.

A pair of elongated weight-supporting rods, 45 and 46 of round metal stock, are provided, each welded centrally of plate-like member 32 to the exposed face 47 of one of the blocks 41 or 42 to extend outwardly for supporting a conventional weight 48 or 49, conventional collar 51 or 52 and conventional set screw 53 or 54. The weight supporting rods 45 and 46 preferably extend in rectilinear alignment, in a common plane, but are separated by the space 55 between the rods and between the blocks 41 and 42.

A hand grip rod 56 is welded, or otherwise affixed, to the exposed face 47 of each block 41 or 42, at the projecting portions 43 or 44 thereof, to extend therebetween, preferably in parallelism with the weight supporting rods 45 and 46, but laterally offset from the common plane thereof, preferably a distance less than one inch. The hand grip rod 56 is also spaced a predetermined distance from the adjacent side 34 of the plate-like member 32 to form a hand, or finger, insertion aperture 57 therebetween so that the hand grip rod may be gripped palms up, supine position as shown.

It will be seen that unlike the conventional barbell or dumbell, wherein the center of gravity is along the weight carrying bar because the hand grip is the straight bar, in this invention the center of gravity is spaced from the plane of the hand grip rod, as best shown in FIG. 4.

In FIG. 4 the exercising device 20 has been curled so that the weight carrying rods and the weights are in rear of the hand grip rod and the plate like member 32 is spreading the weight back to the lower forearm.

A cushioned pad 58 having two surface levels 59 and 61 is affixed to the underface 38 of the plate-like member 32 in order to further spread the pressure and strain and relieve the wrist of undue stress.

In FIG. 7 it should be noted that a central block 62 similar to blocks 41 and 42 divides the hand grip 56 into portions 63 and 64, one for each hand.

In FIG. 6, another embodiment is shown in which the weight carrying rods 66 and 67 are integral with the hand grip rod 68 by reason of being bent at 69 and 71 from a single piece of elongated, round section metal stock.

As shown in FIG. 8, in another embodiment 72 of the invention a pair of weight supporting rods 73 and 74 may each extend away from the shorter ends 75 and 76 of the plate 77 at an angle to the adjacent longer side 78, and hand grip rod 79. As shown, each rod 73 or 74 may be adjustable around a pivot 81 and retained in a desired angular position by a set screw clamp 82 so that the weight 83 carried thereby and the centre of gravity of the weight is at any desired lateral offset from the longitudinally extending hand grip rod 79 and longer side 78. The weight support bars thus may be adjusted to extend normal to the plate in any of the 360° angular positions, some of the angles being more useful and practical than others but those in which the centre of gravity of the weights is away from the palms and rearwardly toward the lower forearm being very workable.

I claim:

1. An exercise device of the barbell and dumbell type especially for use in curling exercises to develop and strengthen the bicep brachii, said device comprising:

an elongated, generally rectangular, weight distributing, plate of rigid material having a pair of opposite longer sides and a pair of opposite shorter ends said plate being padded and being dimensioned to span the heel of the hand, the wrist and the lower forearm;

a pair of elongated weight-supporting end rods each mounted to extend from one of the opposite shorter ends of said plate in a common plane and in rectilinear alignment with a space therebetween;

a weight on each of said elongated weight-supporting end rods; and a hand grip rod means mounted to extend in parallelism with one of the longer sides of said plate, at a spaced distance therefrom, to create a finger insertion aperture, said hand grip rod means being in a plane laterally offset from, but parallel to, the common plane of said weight supporting end rods;

whereby when said hand grip rod means is grasped in palms-up, supine, hand position and the device is curled, the center of gravity is moved back behind the hand grip rod means to the padded plate to span the heel of the hand, wrist and lower forearm.

2. A combination as specified in claim 1 wherein:

said padded plate comprises a thin, metal plate having a pair of blocks integral therewith, each affixed along one of the opposite shorter ends of said plate and each having a portion projecting laterally therefrom a predetermined distance; and said hand grip rod means is affixed to the laterally projecting portion of said blocks.

3. A combination as specified in claim 1 wherein; said weight supporting rods and said hand grip rod means are bent from one piece of metal rod material.

4. A combination as sepecified in claim 1 wherein; said hand grip rod means extends parallel to said weight supporting rods and is laterally offset therefrom, but said offset is less than one inch.

5. A combination as specified in claim 1 wherein:

said padded plate includes a cushioning pad on the underface thereof, having two levels of padding to conform to the natural contour of, and rest on, the heel of the hand, wrist and lower forearm and relieve the wrist of undue stress.

6. A combination as specified in claim 5 wherein:

said cushioning pad has an exposed surface defining two different layers.

7. A barbell, or dumbell having:

a central, elongated weight distributing plate having opposite sides, opposite ends, and dimensioned to span the heel of the hand, the wrist and the lower forearm;

a pair of blocks, each welded along one of said ends and having a portion projecting laterally therefrom;

a pair of weight supporting rods, each welded to one of said blocks to extend beyond the adjacent end of said plate in rectilinear alignment with the other end in a common plane for supporting a weight;

a hand grip rod means welded to the projecting portions of said blocks to extend in parallelism with said weight supporting rods, in a plane laterally offset from said common plane and laterally spaced from the adjacent side of said plate to form a finger insertion aperture therebetween; and a cushioning pad on the under face of said plate between said blocks.

8. A barbell or dumbell comprising:

a padded plate having opposite sides, opposite ends and an underface, said plate being dimensioned to span the heel of the hand, the wrist and the lower forearm;

a pair of support rods, each having one end mounted on one of the opposite ends of said plate and each having its other end extending away from said plate; and a hand grip rod means affixed to said plate to extend along one of said sides in parallelism therewith and at a spaced distance therefrom;

the center of gravity of said barbell or dumbell, when it is curled in palms-up supine hand position, being moved back behind the hand grip rod means to the padded plate spanning the heel of the hand, the wrist and the lower forearm.

9. A barbell or dumbell as specified in claim 8 wherein:

said padded plate includes a cushioning pad on said underface for resting on the heel of the hand, wrist and lower forearm.

10. An exercising device of the barbell and dumbell type especially for use in curling exercises to develop and strengthen the bicep brachii, said device comprising:

an elongated plate of rigid material having a pair of opposite, shorter ends, a pair of opposite longer sides, and an underface, said plate being dimensioned to span the heel of the hand, the wrist and lower forearm;

a pair of weight-supporting end rods, each spaced apart from the other and protruding from one of said ends of said plate;

a weight on each of said rods; and a hand grip rod means, affixed relative to one of the longer sides of said plate to extend in parallelism with said side of said plate, but laterally offset therefrom;

said hand grip rod means being spaced a predetermined distance from the said one longer side of said plate to create a hand insertion space therebetween; and a cushioning pad on said underface of said plate;

the center of gravity of said device being moved back behind said hand grip rod means to said cushioning pad and plate, when the device is curled, to spread the pressure and strain while relieving the wrist of undue stress.

* * * * *